United States Patent [19]

Saleen

[11] 4,184,216

[45] Jan. 22, 1980

[54] INFLATABLE SUSPENDERS

[76] Inventor: Merrill E. Saleen, 1250 W. Ustick Rd., Meridian, Id. 83642

[21] Appl. No.: 694,456

[22] Filed: Jun. 9, 1976

[51] Int. Cl.[2] ..... B63C 9/18

[52] U.S. Cl. ..... 9/318; 2/DIG. 3; 2/310; 9/336; 9/340

[58] Field of Search ..... 9/311, 313, 314, 316, 9/318, 329, 336–339, 340, 342, 343, 345, 400; 2/DIG. 3, 309, 310, 311

[56] References Cited

U.S. PATENT DOCUMENTS

| | | | |
|---|---|---|---|
| 278,432 | 5/1883 | Hoeflich | 9/340 |
| 1,559,059 | 10/1925 | Abbott | 9/338 |
| 2,118,165 | 5/1938 | Christopher et al. | 9/336 X |
| 2,675,143 | 4/1954 | Seemann, Jr. | 9/318 X |
| 3,338,266 | 8/1967 | Zilka et al. | 9/11 A |
| 3,809,288 | 4/1974 | Mackal | 9/316 X |

FOREIGN PATENT DOCUMENTS

| | | | |
|---|---|---|---|
| 1249832 | 11/1960 | France | 9/340 |
| 3280 | of 1876 | United Kingdom | 9/340 |

*Primary Examiner*—Sherman D. Basinger

[57] ABSTRACT

Inflatable suspenders comprise an elongated envelope being closed at its respective end and having fastened in superimposed registry at its mid-point a strap including a slip loop at one of its terminal ends in communication with the envelope to form a substantially Y-shaped construction, the terminal ends of the envelope being closed and being provided with fasteners attachable on to apparel, the terminal end of the strap being provided with fasteners, the envelope being inflatable manually or with a capsule of pressurized gas, and a trigger mechanism selectively opening the capsule of gas.

4 Claims, 4 Drawing Figures

INFLATABLE SUSPENDERS

FIELD OF INVENTION

The present invention relates to apparel and life preservers and more particularly to inflatable suspenders.

DESCRIPTION OF THE PRIOR ART

It is a notorious problem for people such as fishermen, loggers and sportsmen who engage in activities which require wading into dangerous waters that there has heretofore been provided no means which both support wading boots, hip waders and the like, and which may serve as a life preserver. Generally, wading apparel is of bulky, loose-fitting construction, which requires elastic support usually over the shoulders by means such as suspenders. This requirement in the wading apparel results in an unsatisfactory fitting of jacket-type life preservers. Furthermore, most wading activities require a great deal of mobility which, again, decreases the success of jacket-type preservers.

Accordingly, it is an object of the present invention to provide suspenders for wading apparel, which suspenders are provided with means for selectively inflating the suspenders to provide the life preservers.

It is a further object of this invention to provide compact means inflating suspenders of this invention which is both fast operating and compact.

These and other objects shall become apparent from the description following, it being understood that modifications may be made without affecting the teachings of the invention here set out.

SUMMARY OF THE INVENTION

The inflatable suspenders of this invention comprise an elongated envelope being closed at its terminal ends and having in superimposed registry at its mid-point a strap including a slip loop at one of its terminal ends in communication with the envelope to form a substantially Y-shaped construction, the terminal ends of the envelope being closed and being provided with fasteners attachable to apparel, the terminal end of the strap being provided with fasteners, the envelope being inflatable manually or with a capsule of pressurized gas, and means selectively opening the capsule of gas. When inflated the body is buoyed forwardly at the shoulders, so that the head of the wearer is out of the water.

A more thorough and comprehensive understanding may be had from the detailed description of the preferred embodiment when read in connection with the drawings forming a part of this specification.

DETAILED DESCRIPTION OF THE PREFERRED EMBODIMENT

Figure 1:
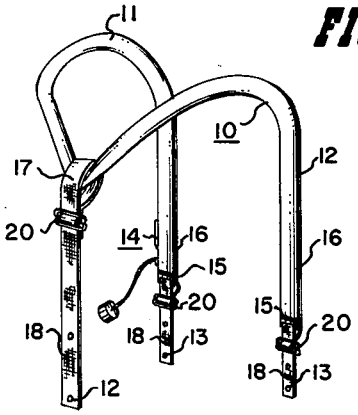
FIG. 1 is a front perspective view of the inflatable suspenders of this invention showing to advantage the slip loop of the retaining strap.
Figure 3:
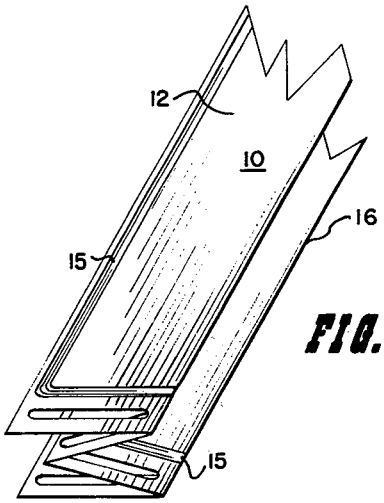
FIG. 3 is a fragmentary detailed view of the construction and folding of the envelope of the invention.

Referring now to the drawings and more particularly to the FIG. 1, the inflatable suspenders of this invention are shown to advantage and generally identified by the numeral 10. The inflatable suspenders 10 comprise elongated envelope 11, a support strap 12, suspenders fasteners 13 at the respective terminal ends of the envelope 1, and an inflation assembly 14. It is to be understood that the suspenders may be engagable with any of a variety of trouser apparel such as wading boots, wading trousers or ordinary trousers, or even a belt.

Figure 2:
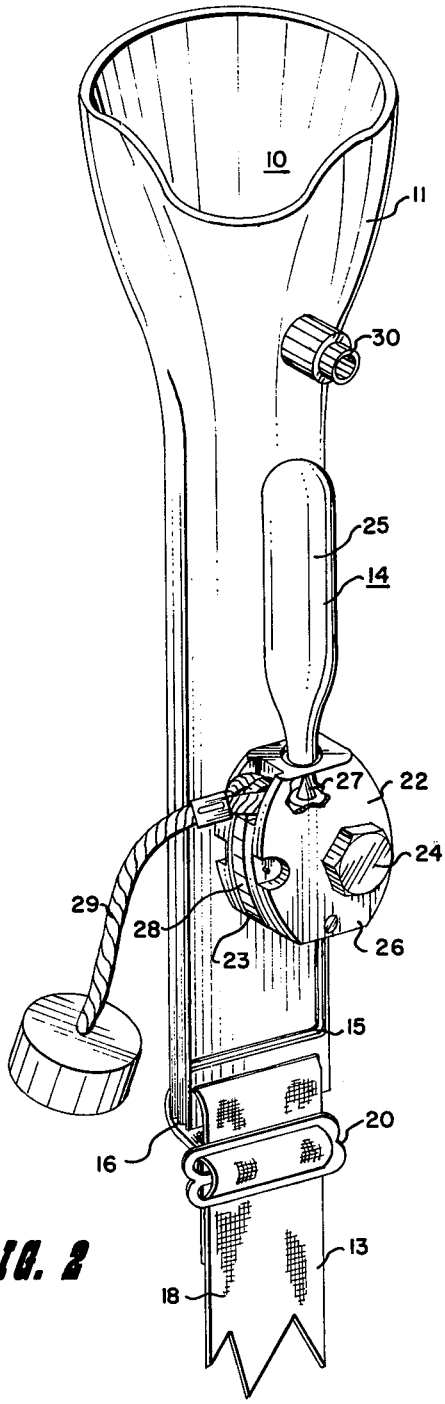
FIG. 2 is a fragmentary perspective view of the inflation assembly of this invention shown with certain of its walls broken away for illustrative purposes.
Figure 4:
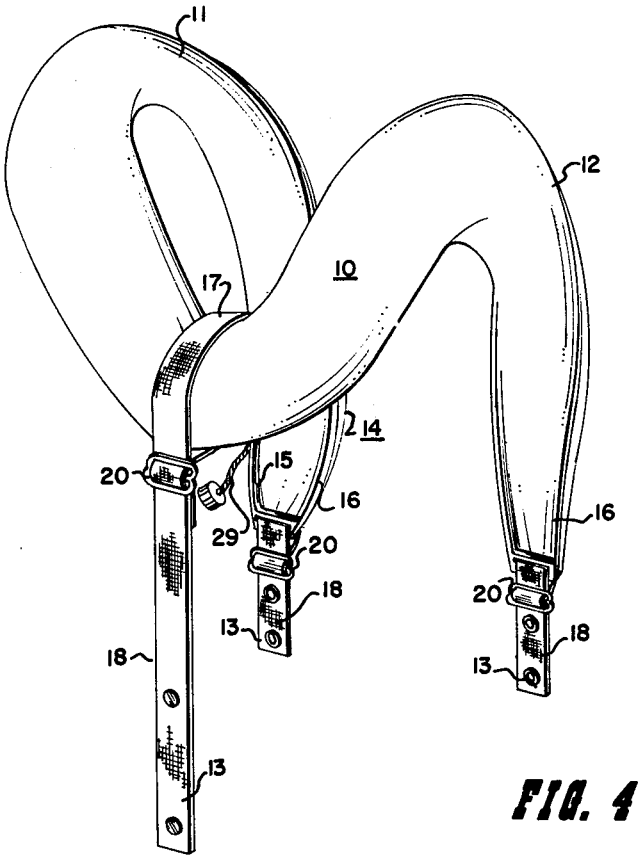
FIG. 4 shows the envelope inflated.

The envelope is a resilient tube, and may be fabricated of sheets of elastomeric material laminated to form the necessary longitudinal closure such as shown at 15 in the FIG. 2. It has been found to advantage to fabricate sideward portions of the envelope 11 with pleats 16 to permit the envelope 11 to assume a flat configuration when deflated. The envelope 11 is held at its mid-point by the strap 12 in registry, and thereby form a Y-shaped structure, associated with commonly known suspenders. The strap 12 is provided with a slip loop 17 which permits inflation of the envelope 11.

The terminal ends of the envelope 11 are closed by and provided with the suspenders fasteners 13. The suspenders fasteners 13 may be selected from any of a variety of commonly known suspender securing fasteners now offered in commerce. Typically, these suspenders fasteners 13 comprise an elastic web 18 and trouser engaging ears 19 which are secured to the web 18 by a ring or loop 20.

The inflating assembly 14 comprises a gas capsule recepticle 22, and a trigger mechanism 23. The inflating valve assembly 24 is typical of valves commonly known in the art to inflate life vests, life rafts and the like. The gas capsule recepticle 22 is threadable or compression-type female coupling operable to receive a gas capsule such as miniaturized carbon dioxide bottle 25, a type now offered in commerce. The recepticle 22 is operable to support the capsule 25 in a substantially verticle position in registry with the longitudinal axis with one of the envelope 11 on which it is carried. The trigger mechanism 23 comprises a housing 26 which is disposed vertically in registry with the central longitudinal axis of the capsule 25 in the housing 26 and a cam arm 28 which is pivotally mounted in the housing 26 below the pin 27. The pin 27 is urged into the closure at the neck of the capsule 25 in response to movement of the cam arm 28. The assembly 14 is secured to its respective envelope at the entranceway (Not Shown) and by suitable bonding at the housing 26. In operation, a capsule 25 is engaged in a recepticle 22. In case of emergency, the cam 28 is pivoted by direct pressure or from a pull cord 29 to drive the pin 27 to break the seal in the capsule 25. It has been found to advantage to provide an air release valve 30 at a location on the suspenders remote from the assembly 14. The air release valve 30 may simply be opened to permit the gas under pressure trapped in the envelope to escape.

Having thus described in detail a preferred apparatus which embodies the concepts and principles of the invention and which accomplishes the various objects, purposes and aims thereof, it is to be appreciated and will be apparent to those skilled in the art that many physical changes could be made in the apparatus without altering the inventive concepts and principles embodied therein. Hence, it is intended that the scope of the invention be limited only to the extent indicated in the appended claims.

I claim:

1. Inflatable suspenders, comprising:

an elongated envelope being closed at its respective terminal ends and having fastened in superimposed registry over a portion at its mid-point a strap including a slip hook at one of its terminal ends to form a substantially Y-shaped construction, the terminal ends of said envelope being closed and being provided with fasteners being means engageable with suspender buttons on an apparel; and means inflating said envelope, said means including a capsule of pressurized gas, and means selectively opening said capsule of gas.

2. The article of claim 1 wherein said means opening said gas capsule comprises a housing said housing having a receptacle detachably engaging the orifice neck of said capsule, a pin being slidable in said housing to break the closure provided in said capsule neck, and an eccentric arm pivotally mounted in said housing actuating said pin to break said closure.

3. The article of claim 1 including an air release valve disposed in walls of said envelope.

4. The article of claim 1 wherein said envelope is pleated providing a flat construction when a low pressure condition exists in said envelope.

* * * * *